US005533670A

United States Patent [19]

Chen

[11] Patent Number: 5,533,670

[45] Date of Patent: Jul. 9, 1996

[54] RAIL JOINT FOR EXPANSION BETWEEN RAILS WITH INVERTED T-SHAPED BASE HOLDER

[76] Inventor: Chi-Shiang Chen, No. 15, Chung-Shan Rd., Su-Ao Chen, I-Lan Hsien, Taiwan

[21] Appl. No.: 416,982

[22] Filed: Apr. 5, 1995

[51] Int. Cl.[6] ..... E01B 11/02; E01B 11/42

[52] U.S. Cl. ..... 238/187; 238/230; 238/248

[58] Field of Search ..... 238/126, 151, 238/175, 176, 177, 187, 188, 195, 209, 230, 248, 154, 155, 157

[56] References Cited

U.S. PATENT DOCUMENTS

| | | | |
|---|---|---|---|
| 1,109,440 | 9/1914 | McElrath | 238/151 |
| 1,583,426 | 5/1926 | Singeltary | 238/188 |

FOREIGN PATENT DOCUMENTS

| | | | |
|---|---|---|---|
| 1081506 | 12/1954 | France | 238/230 |
| 158745 | 12/1932 | Switzerland | 238/230 |
| 11446 | 4/1896 | United Kingdom | 238/188 |

*Primary Examiner*—S. Joseph Morano

*Attorney, Agent, or Firm*—Oblon, Spivak, McClelland, Maier & Neustadt

[57] ABSTRACT

A rail joint for interconnecting two successive rail bars of a railroad track includes longitudinally aligned first and second guide rails. Each of the guide rails has a mounting end adapted to be secured to a respective one of adjacent end portions of the rail bars, a distal end opposite to the mounting end and spaced from the distal end of the other one of the guide rails at an expansible space, and a downwardly and longitudinally extending dovetail projection. A connector is adapted to be fixed on the railroad track and is formed with an upwardly opening and longitudinally extending dovetail groove for receiving fittingly the dovetail projections of the guide rails therein so as to maintain alignment of the guide rails.

4 Claims, 6 Drawing Sheets

RAIL JOINT FOR EXPANSION BETWEEN RAILS WITH INVERTED T-SHAPED BASE HOLDER

BACKGROUND OF THE INVENTION

1. Field of the Invention

This invention relates to a rail joint, more particularly to a rail joint which is used for interconnecting two successive rail bars of a railroad track so as to reduce vibration and noise generated by a train when the train passes over the rail joint of the railroad track.

2. Description of the Related Art

The improvement of this invention is directed to a conventional rail joint which is used for interconnecting two successive rail bars of a railroad track.

Referring to FIG. 1, a railroad track 10 includes two rows of successive rail bars 11 which are fixed on several transverse sleepers 12 in a known manner and which support wheels 20 (only one is shown) of a train thereon. Any successive two of the rail bars 11 form an expansible space 13 between their adjacent end portions so as to permit thermal expansion of the rail bars 11. The successive rail bars 11 are then connected to each other by means of a conventional rail joint to ensure alignment of the successive rail bars 11 in order to avoid violent vibration of the successive rail bars 11 when the wheels 20 of the train pass over the expansible space 13, thereby minimizing unsteady movement of the train. The conventional rail joint usually includes a pair of fishplates 14 (only one is shown) which are mounted securely to two opposite side walls of the successive rail bars 11 by means of bolts 15. However, owing to the frequent thermal expansion and contraction of the successive rail bars 11, the bolts 15 are easily loosened from the successive rail bars 11 to result in untimely removal of the fishplates 14 from the successive rail bars 11. Thus, the expansible spaces 13 in any two adjacent end portions of the rail bars 11 cannot be maintained at equal distances. This results in violent vibration of the train when the wheels of the train pass over the unequal expansible spaces 13. Accordingly, it is necessary to inspect frequently the combination of the bolts 15 and the successive rail bars 11 to ensure that the fishplates 14 remain mounted securely to the successive rail bars 11.

In addition, the adjacent end portions of the successive rail bars 11 are respectively provided with vertical and flat end surfaces. As the train moves along the railroad track 10, each wheel 20 of the train is transferred from the adjacent end portion of one of the rail bars 11 onto the adjacent end portion of the other one of the rail bars 11 within a very short time such that the adjacent end portion of the other one of the rail bars 11 has to burden instantaneously the weight carried by the wheel 20. As a result, the impact of the wheel 20 with the other one of the rail bars 11 during the transfer process may result in violent vibration of the train and in a very loud noise.

In order to overcome the above described drawback, an improved railroad track has been disclosed in U.S. Pat. No. 207,792. As disclosed, each of opposed end portions of each of aligned rail bars of the railroad track has an inclined end face that is parallel to an inclined end face of an adjacent one of the rail bars. The inclined end faces are oriented at a predetermined angle relative to the longitudinal axes of the rail bars. Accordingly, when a train moves along the railroad track, one wheel of the train is transferred gradually from a previous rail bar to a succeeding adjacent rail bar so as to reduce the impact of the wheel with the end portion of the adjacent rail bar, thereby consequently generating less noise and vibration.

However, the impact of the wheel with the end portion of the adjacent rail bar easily causes damage to a pointed end of the inclined end surface of the end portion of the adjacent rail bar. Thus, the rail bars of the railroad track have to be replaced frequently.

SUMMARY OF THE INVENTION

Therefore, the main objective of the present invention is to provide a rail joint which interconnects two successive rail bars of a railroad track for ensuring alignment of the successive rail bars and for keeping expansible spaces between any two of the successive rail tracks at equal distances so as to reduce vibration and noise generated by a train when the train passes over the rail joint.

Another objective of the present invention is to provide a rail joint which has two complementary face units provided respectively on two adjacent end portions of the successive rail bars for avoiding damage to the adjacent end portions of the successive rail bars due to impact of one wheel of a train with the adjacent end portions of the successive rail bars.

According to this invention, a rail joint for interconnecting two successive rail bars of a railroad track includes longitudinally aligned first and second guide rails. Each of the guide rails has a mounting end adapted to be secured to a respective one of adjacent end portions of the rail bars, a distal end opposite to the mounting end and spaced from the distal end of the other one of the first and second guide rails at an expansible space, and a downwardly and longitudinally extending dovetail projection.

A connector is adapted to be fixed on the railroad track and is formed with an upwardly opening and longitudinally extending dovetail groove for receiving fittingly the dovetail projections of the first and second guide rails therein so as to maintain alignment of the first and second guide rails.

The dovetail projection is an inverted T-shaped plate which has an upright web portion and two horizontal base portions. Each of the base portions extends transversely and outwardly from a respective one of two sides of a lower end of the web portion.

The dovetail groove is an inverted T-shaped groove. The connector has a base plate which is adapted to be fixed on the railroad track and which carries the base portions of the inverted T-shaped plate thereon, and two longitudinally extending bent clamp plates which project upwardly from the base plate and which are spaced from each other to confine the inverted T-shaped groove therebetween. The clamp plates have vertical lower portions to flank the base portions of the inverted T-shaped plate, horizontal middle portions which extend respectively from upper ends of the lower portions and toward each other to cover the base portions, and vertical upper portions which extend respectively and upwardly from distal ends of the middle portions to flank the web portion of the inverted T-shaped plate.

The connector further has means for fastening one of the first and second guide rails to the connector. The fastening means includes an aligned pair of holes formed respectively through the upper portions of the clamp plates, and a pin extending fittingly through the holes and through the web portion of the inverted T-shaped plate of said one of the first and second guide rails, thereby fastening said one of the first and second guide rails to the connector.

The first guide rail has a first face unit formed on an end surface of the distal end thereof. The first face unit has two spaced flat edge sections with a predetermined longitudinal length of the first guide rail formed therebetween, and an inclined intermediate section interconnecting the flat edge sections. The second guide rail has a second face unit which is formed on an end surface of the distal end thereof and which complements the first face unit.

BRIEF DESCRIPTION OF THE DRAWINGS

Other features and advantages of this invention will become apparent in the following detailed description of a preferred embodiment of this invention, with reference to the accompanying drawings, in which.

DESCRIPTION OF THE PREFERRED EMBODIMENT

Figure 1:
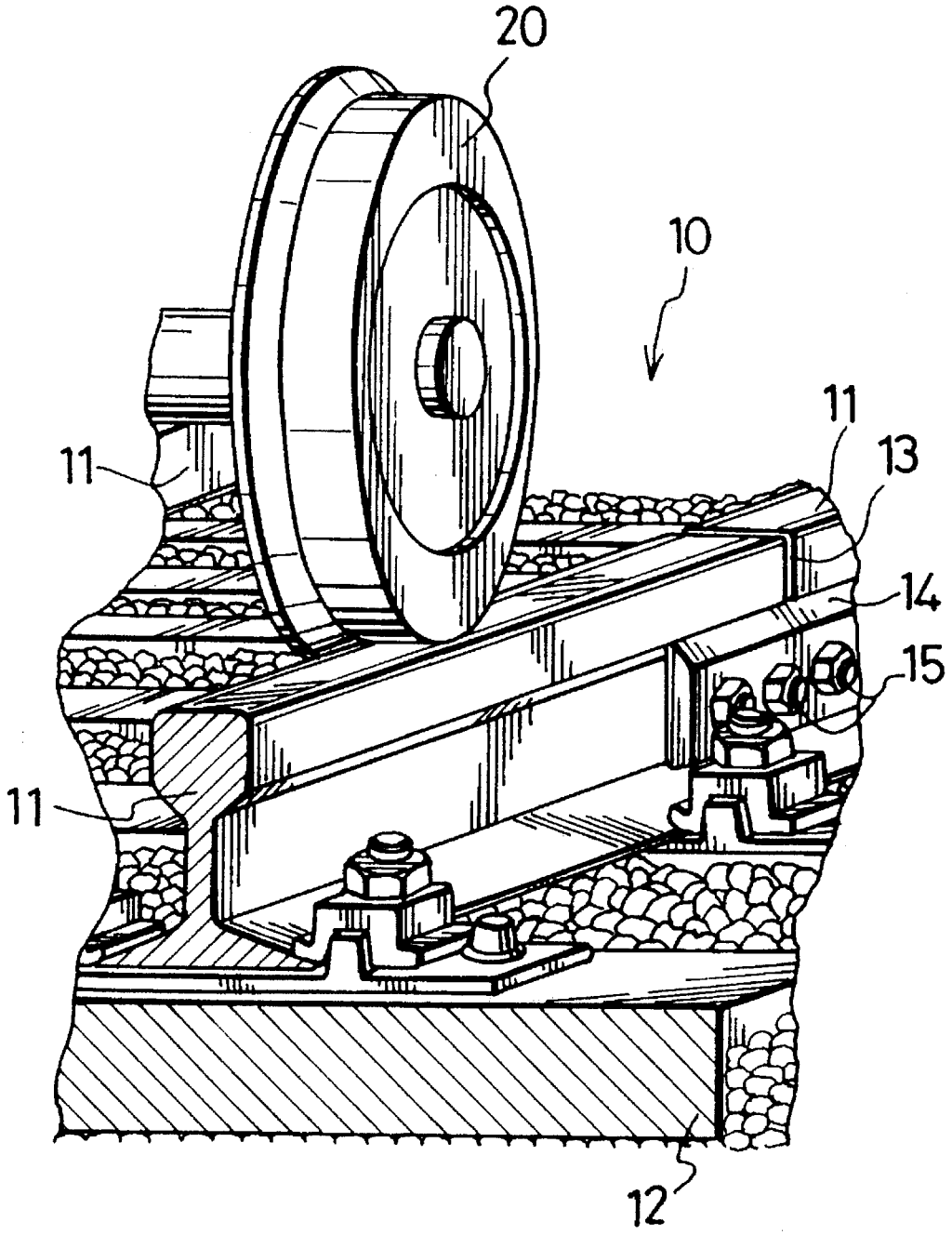
FIG. 1 (PRIOR ART)
FIG. 1 is a partially perspective view showing a conventional railroad track which carries a wheel of a train.
Figure 2:
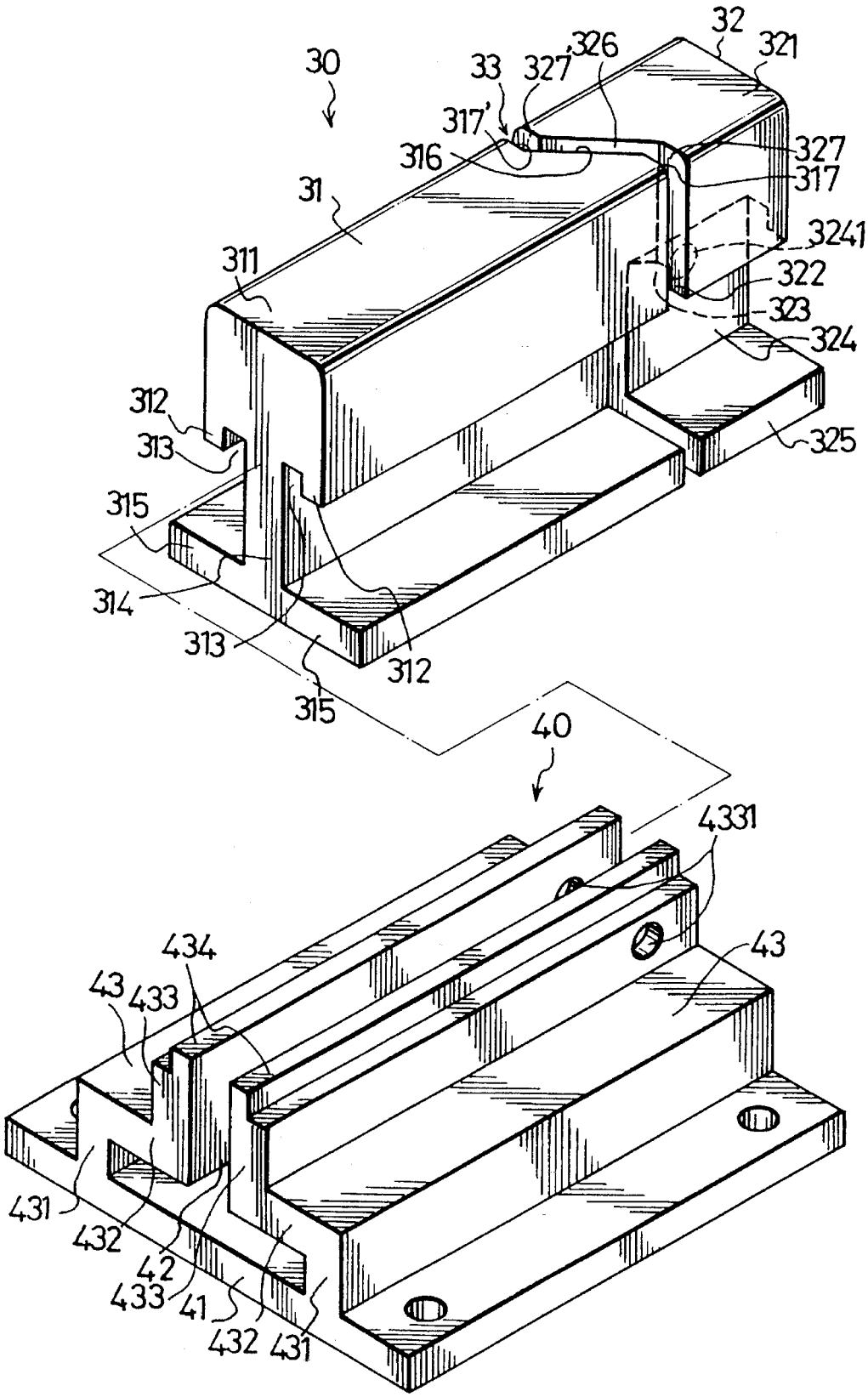
FIG. 2 is an exploded view showing a preferred embodiment of a rail joint of this invention.
Figure 4:
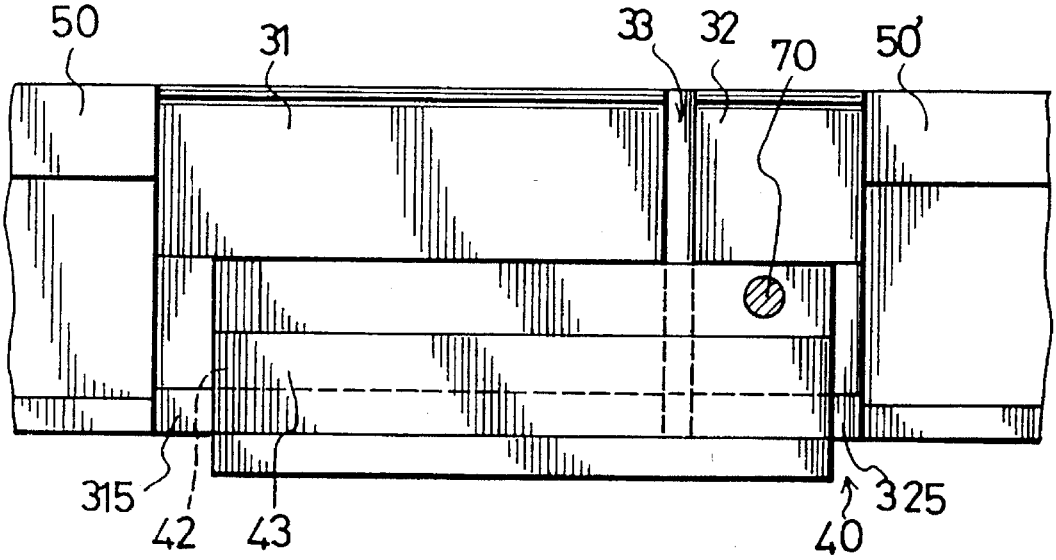
FIG. 4 is a schematic view illustrating how the guide rails of the rail joint are respectively secured to adjacent end portions of two successive rail bars of the rail track in accordance with this invention.

Referring to FIGS. 2 and 4, a preferred embodiment of a rail joint 30 according to this invention is used for interconnecting two successive rail bars 50, 50' (see FIG. 4) of a railroad track. The rail joint 30 includes longitudinally aligned first and second guide rails 31, 32 which are installed on two adjacent end portions of the rail bars 50, 50', and a connector 40 which is to be fixed on the railroad track to interconnect the first and second guide rails 31, 32 so as to ensure alignment of the first and second guide rails 31, 32.

Figure 3:
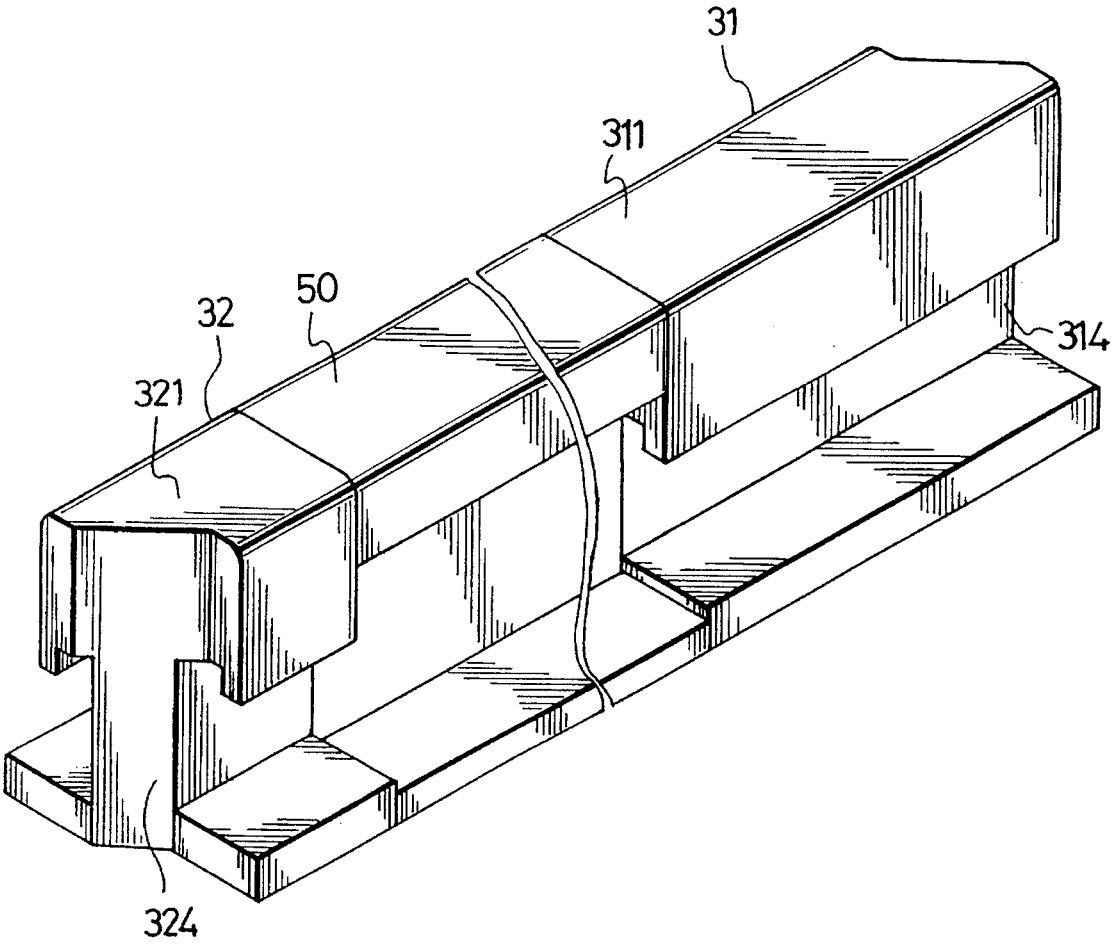
FIG. 3 is a perspective view illustrating how two guide rails of the rail joint are respectively secured to two opposite end portions of a rail bar of a railroad track in accordance with this invention.

Each of the first and second guide rails 31, 32 has a mounting end secured to a respective one of the adjacent end portions of the rail bars 50, 50', such as by welding, and a distal end opposite to the mounting end and spaced from the distal end of the other one of the first and second guide rails 31, 32 at an expansible space 33. During assembly, the first and second guide rails 31, 32 are welded directly on two opposite end portions of the rail bar 50, as shown in FIG. 3. Then, several rail bars 50 are arranged to constitute a railroad track.

Referring again to FIGS. 2 and 4, the first and second guide rails 31, 32 further have head portions 311, 321 with top surfaces that are flush with the top surfaces of the rail bars 50, 50' (see FIG. 3) for carrying wheels of a train thereon, downwardly and longitudinally extending dovetail projections projecting from bottom sides of the head portions 311, 321 respectively, and first and second face units formed respectively on end surfaces of the distal ends of the first and second guide rails 31, 32. In this embodiment, the dovetail projections are inverted T-shaped plates It is noted that the first and second guide rails 31, 32 are substantially similar in construction to each other. Therefore, only the first guide rail 31 will be described in detail in the following paragraph.

The inverted T-shaped plate of the first guide rail 31 has an upright web portion 314 and two horizontal base portions 315, each of which extends transversely and outwardly from a respective one of two sides of a lower end of the web portion 314. The first guide rail 31 further has two longitudinally and downwardly extending flanges 312 which project downwardly from the bottom side of the head portion 311 and which are located at two sides of the web portion 314 of the inverted T-shaped plate thereof for defining two longitudinal retaining grooves 313 between the web portion 314 and the flanges 312.

The inverted T-shaped plate of the second guide rail 32 also has an upright web portion 324 and two horizontal base portions 325 (only one is shown), while the web portion 324 further has a hole 3241 formed therethrough. Two longitudinal retaining grooves 323 (only one is shown) of the second guide rail 32, which are defined between the web portion 324 and two flanges 322 (only one is shown), are aligned respectively with the retaining grooves 313.

Figure 5:
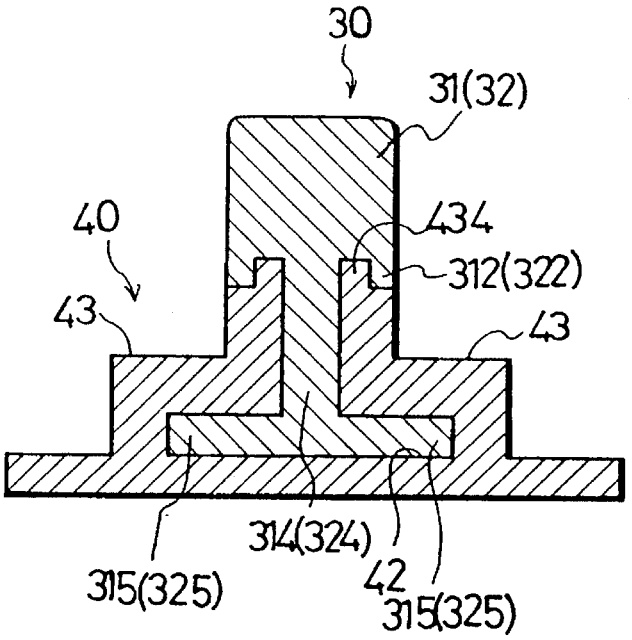
FIG. 5 is a sectional view showing assembly of the rail joint of this invention.
Figure 7:
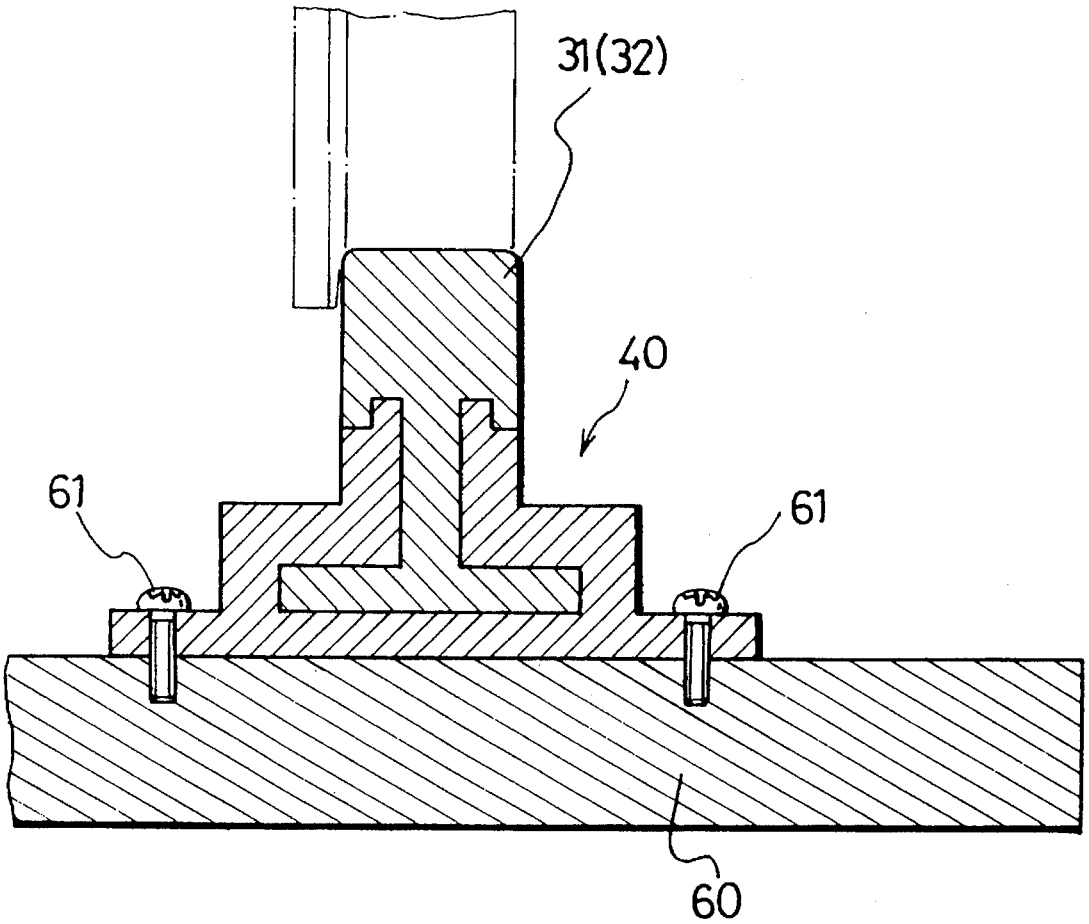
FIG. 7 is a sectional view illustrating how the rail joint is fixed to a sleeper of the railroad track in accordance with this invention.

The connector 40 includes a base plate 41 which is fixed on a sleeper 60 of the railroad track, as shown in FIG. 7, in a known manner, such as by means of bolts 61. Referring to FIGS. 2 and 5, the base plate 41 can carry the base portions 315, 325 thereon. The connector 40 further includes two longitudinally extending bent clamp plates 43 which project upwardly from the base plate 41 and which are spaced from each other to confine an upwardly opening and longitudinally extending dovetail groove therebetween. In this embodiment, the dovetail groove is an inverted T-shaped groove 42 for receiving fittingly the inverted T-shaped plates of the first and second guide rails 31, 32 therein. The champ plates 43 have vertical lower portions 431 to flank the base portions 315, 325 of the inverted T-shaped plates of the first and second guide rails 31, 32, horizontal middle portions 432 extending from upper ends of the lower portions 431 and toward each other to cover the base portions 315, 325, vertical upper portions 433 extending upwardly from distal ends of the middle portions 432 to flank the web portions 314, 324 of the inverted T-shaped plates of the first and second guide rails 31, 32, and longitudinal tongues 434 projecting upwardly from top surfaces of the upper portions 433 to engage the retaining grooves 313, 323 of the first and second guide rails 31, 32. In this way, the clamp plates 43 can maintain efficiently alignment of the first and second guide rails 31, 32 to avoid violent vibration of the first and second guide rails 31, 32 when the wheels of the train pass over the rail joint 30, thereby reducing vibration and noise generated by the train so as to minimize unsteady movement of the train.

In addition, the connector 40 further has means for fastening the second guide rail 32 to the connector 40. The fastening means includes an aligned pair of holes 4331 formed respectively through the upper portions 433 of the clamp plates 43 and aligned with the hole 3241 of the second guide rail 32. A pin 70 (see FIG. 4) extends fittingly through and is fixed within the holes 4331, 3241 by welding so as to fasten the second guide rail 32 to the connector 40. As a result, only the first guide rail 31 can expand with heat within the inverted T-shaped groove 42 of the connector 40 and along a longitudinal direction toward the second guide rail 32. Thus, the expansible spaces 33 between adjacent pairs of the first and second guide rails 31, 32 can always be maintained at equal distances during thermal expansion. Therefore, the train can move smoothly and steadily along the railroad track as the wheels of the train pass over the rail joint 30 of this invention.

Figure 6:
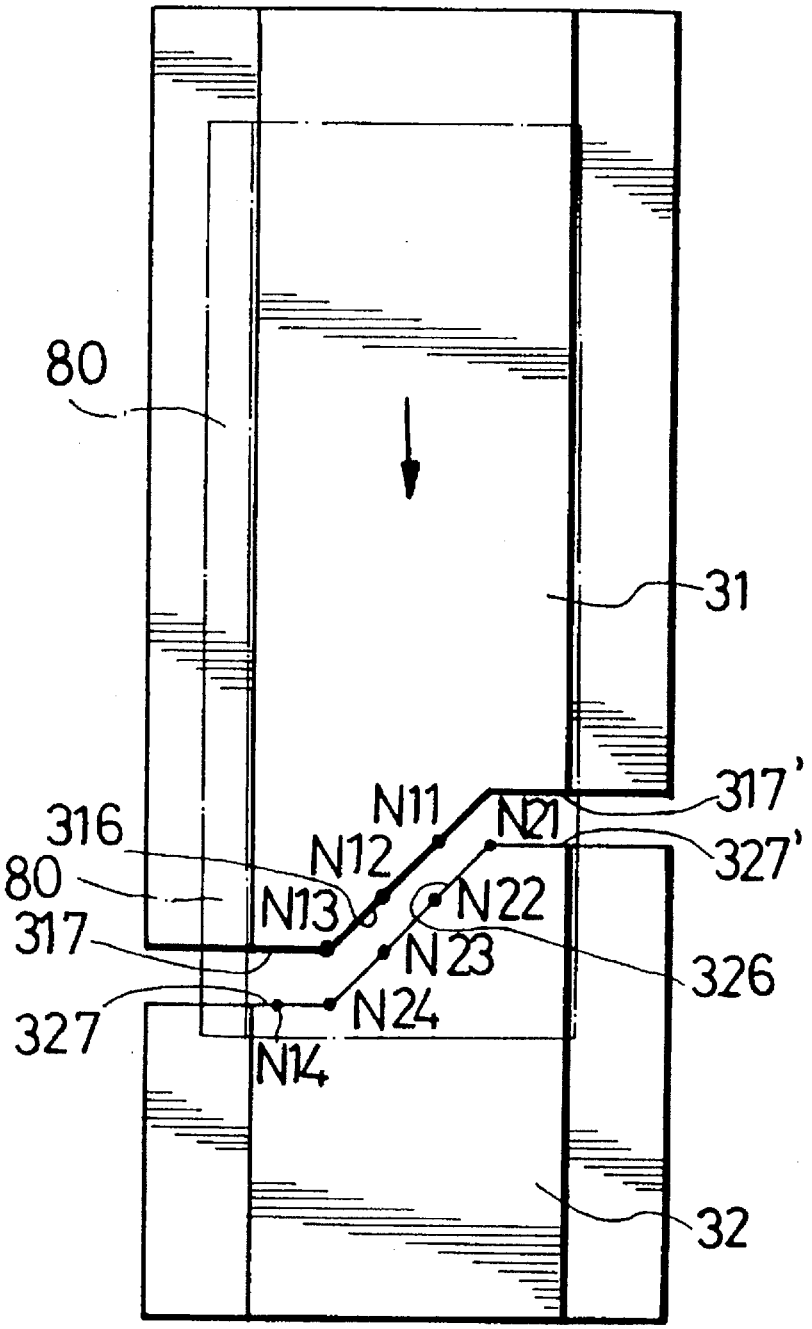
FIG. 6 is a schematic view illustrating the movement of a wheel of a train along top surfaces of the guide rails of the rail joint in accordance with this invention.

Referring to FIGS. 2 and 6, the first face unit of the first guide rail 31 has two spaced flat edge sections 317, 317' with a predetermined longitudinal length of the first guide rail 31 formed therebetween, and an inclined intermediate section 316 interconnecting the flat edge sections 317, 317'. The second face unit of the second guide rail 32 complements the first face unit of the first guide rail 31 and also has two spaced flat edge sections 327, 327' and an inclined intermediate section 326.

Referring to FIG. 6, when a train moves along the railroad track in a direction indicated by the arrow sign, one wheel 80 of the train travels from the flat edge section 317' of the first face unit of the first guide rail 31 toward the second guide rail 32. Then, the weight carried by the wheel 80 is transferred gradually from the inclined intermediate section 316 of the first face unit of the first guide rail 31 to the inclined intermediate section 326 of the second face unit of the second guide rail 32 Upon reaching successively first contact points (N11, N21), second contact points (N12, N22), and third contact points (N13, N23). Finally, the front edge of the wheel 80 is transferred entirely from the first guide rail 31 to the flat edge section 327 of the second face unit of the second guide rail 32 upon reaching fourth contact points (N14, N24). The gradual transfer of the weight carried by the wheel 80 from the first guide rail 31 to the second guide rail 32 can reduce impact of the wheel 80 with the distal end of the second guide rail 32, thereby further reducing noise and vibration generated by the train.

It is important to note that the flat edge sections 327, 327' of the second face unit of the second guide rail 32 have a larger strength for enduring impact of the wheel 80 so as to avoid damage such as that to the pointed end of the inclined end surface of the end portion of the conventional rail bar as described hereinbefore.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A rail joint interconnecting two successive rail bars of a railroad track, said rail bars having adjacent end portions, said rail joint comprising:

longitudinally aligned first and second guide rails, each having a mounting end secured to the end portion of a respective one of the rail bars, a distal end opposite to said mounting end and spaced from said distal end of the other one of said guide rails by an expansible space, and a downwardly and longitudinally extending dovetail projection shaped as an inverted T-shaped plate, said dovetail projection having an upright web portion and two horizontal base portions, each of which extends transversely and outwardly from a respective one of two sides of a lower end of said web portion; and an integral connector fixed on the railroad track and formed with an upwardly opening and longitudinally extending dovetail groove that is inverted T-shaped and fittingly receives said dovetail projections of said first and second guide rails therein so as to maintain alignment of said first and second guide rails, said connector having a base plate which is fixed on the railroad track and which carries said base portions of said dovetail projections thereon, and two longitudinally extending bent clamp plates which project upwardly from said base plate, are spaced from each other and confine said dovetail groove therebetween, said clamp plates having vertical lower portions to flank said base portions of said dovetail projections, horizontal middle portions which extend respectively from upper ends of said lower portions and toward each other to cover said base portions, and vertical upper portions which extend respectively upwardly from distal ends of said middle portions to flank said web portion of said dovetail projections;

only one of said first and second guide rails being fastened to said connector, said upper portions of said clamp plates having an aligned pair of holes formed respectively therethrough, said connector further having a pin which extends fittingly through said holes and through said web portion of said dovetail projection of said one of said first and second guide rails to fasten said one of said first and second guide rails to said connector.

2. A rail joint as claimed in claim 1, wherein each of said first and second guide rails has two longitudinally and downwardly extending flanges at two sides of said web portion of said inverted T-shaped plate thereof for defining two longitudinal retaining grooves between said web portion and said flanges, said connector having two longitudinal tongues projecting upwardly from top surfaces of said upper portions of said clamp plates for engaging said retaining grooves.

3. A rail joint as claimed in claim 1, wherein said first guide rail has a first face unit formed on an end surface of said distal end thereof, said first face unit having two spaced flat edge sections with a predetermined longitudinal length of said first guide rail formed therebetween, and an inclined intermediate section interconnecting said flat edge sections, said second guide rail having a second face unit which is formed on an end surface of said distal end thereof and which complements said first face unit.

4. A rail joint as claimed in claim 1, wherein said first and second guide rails have top surfaces flush with top surfaces of the rail bars.

* * * * *